United States Patent [19]

Wakabayashi et al.

[11] Patent Number: 5,055,859

[45] Date of Patent: Oct. 8, 1991

[54] INTEGRATED THERMAL PRINTHEAD AND DRIVING CIRCUIT

[75] Inventors: Takeshi Wakabayashi, Hidaka; Tsuneo Ochi, Fuchu, both of Japan

[73] Assignee: Casio Computer Co., Ltd., Tokyo, Japan

[21] Appl. No.: 430,885

[22] Filed: Nov. 2, 1989

[30] Foreign Application Priority Data

| | | | |
|---|---|---|---|
| Nov. 16, 1988 | [JP] | Japan | 63-287549 |
| Nov. 18, 1988 | [JP] | Japan | 63-290287 |
| Mar. 28, 1989 | [JP] | Japan | 1-76237 |

[51] Int. Cl.[5] ..... B41J 2/34

[52] U.S. Cl. ..... 346/76 PH; 219/543

[58] Field of Search ..... 346/76 PH; 357/51, 59; 219/543

[56] References Cited

U.S. PATENT DOCUMENTS

| | | | |
|---|---|---|---|
| 3,813,513 | 5/1974 | Vora et al. | 219/216 |
| 4,429,321 | 1/1984 | Matsumoto | 346/140 R |
| 4,660,052 | 4/1987 | Kaiya et al. | 346/76 PH |

FOREIGN PATENT DOCUMENTS

| | | | |
|---|---|---|---|
| 0129914 | 1/1985 | European Pat. Off. . | |
| 0235827 | 9/1987 | European Pat. Off. | 346/76 PH |

*Primary Examiner*—Benjamin R. Fuller
*Assistant Examiner*—Huan Tran
*Attorney, Agent, or Firm*—Frishauf, Holtz, Goodman & Woodward

[57] ABSTRACT

Disclosed is a thermal print head in which heating resistance elements are arranged with high density. The thermal print head comprises a head substrate, formed of a single-crystal silicon wafer, and a print driver circuit element. The print driver circuit element, which is formed by doping the head substrate directly with an impurity, is composed of an MOS FET. A FET used to form the single-crystal silicon substrate has high electrical mobility, and serves to improve the operating speed of the thermal print head. Each heating resistance element, whose base material is polycrystalline silicon, is adjusted to a predetermined resistance value by being subjected to diffusion of an impurity. The resistance elements are formed on a protuberance which is formed on the head substrate. Thus, the portion of an insulating protective film which corresponds to the protuberance projects outward from the rest, thereby ensuring contact with a printing sheet. An earthing diode or laminate structure is used for an earth line of each heating resistance elements so that the resistance element is situated close to a side edge portion of the head substrate.

13 Claims, 10 Drawing Sheets

1
2
3
(C-MOS)
(P-MOS)
(N-MOS)
4
5
6
10
11
12
13
14
15
16
17
18
19
20
21
22
23
24
25
26
27
28
29
30
31

2
2a
2b
2c
2d
D
Cl
Q
L
GATE
Tr
3a
3b
3c
3
4
5
6
7

INTEGRATED THERMAL PRINTHEAD AND DRIVING CIRCUIT

BACKGROUND OF THE INVENTION

1. Field of the Invention

The present invention relates to a thermal print head for thermal recording and a method for manufacturing the same.

2. Description of the Related Art

In conventional thermal print heads which perform thermal recording through selective heating of heating elements, only the heating elements are formed on an insulating substrate of ceramics or quartz, that is, they are formed separately from a print driver circuit section. The individual resistance elements are connected to the driver circuit section by wire-bonding or the like. In these thermal print heads, a drive signal is supplied from the driver circuit section to each resistance element through a wire, whereby the resistance elements are selectively heated so that a thermal ink sheet is heated to effect thermal printing on a recording sheet.

If the print dot pitch is fine, according to the thermal print heads of this type, the spaces between wiring conductors, which are connected to the heating elements, are so narrow that the heating elements and the print driver circuit section cannot be easily connected. Accordingly, the wiring conductors of the print head are fanned out from the heating-element side so that their extended portions are connected to the driver circuit section by wire-bonding. However, the wire-bonding is not a highly efficient method of connection, and the thermal print heads must be large-sized.

According to the wire-bonding method, moreover, bonding regions are protuberant. Since there is hardly any allowance for deformation after the bonding regions are sealed by means of resin, the configuration of the resulting assembly must be maintained before the bonding. Thus, the assembly work is a hard task, and the reliability of the products is lowered after prolonged use.

Recently, therefore, a novel arrangement has been proposed such that heating elements and print driver circuit elements for heating the heating elements are formed together on one and the same insulating substrate.

SUMMARY OF THE INVENTION

The object of the present invention is to provide a thermal print head of high productivity, in which heating elements are arranged with high density, and a method for manufacturing the same.

A thermal print head according to the present invention comprises: a single-crystal semiconductor substrate; a print driver circuit element formed by implanting an impurity into a predetermined region of the semiconductor substrate; a polycrystalline silicon layer formed on the semiconductor substrate and including a low-resistance region for heating; a thin-film conductor for wiring, the conductor connecting the print driver circuit element and the polycrystalline silicon layer; an external connecting terminal connected to the thin-film conductor; and an insulating protective film covering the print driver circuit element and the polycrystalline silicon layer.

A method for manufacturing a thermal print head according to the present invention comprises: a process for forming an insulating layer on a semiconductor substrate; a process for forming a gate insulating layer after removing an active region of the insulating layer; a process for depositing polycrystalline silicon on the insulating layer and the gate insulating layer and forming a heating resistance element and a gate electrode by etching; a process for implanting an impurity at least into the heating resistance element, thereby increasing and reducing the impurity concentration and resistance value, respectively, of the heating resistance element; a process for implanting the impurity into an active region of the semiconductor substrate; a process for depositing a low-resistance metal to form a wiring conductor; and a process for depositing an insulating protective film on the whole surface of the resulting structure.

DETAILED DESCRIPTION OF THE PREFERRED EMBODIMENTS

First Embodiment

Figure 1:
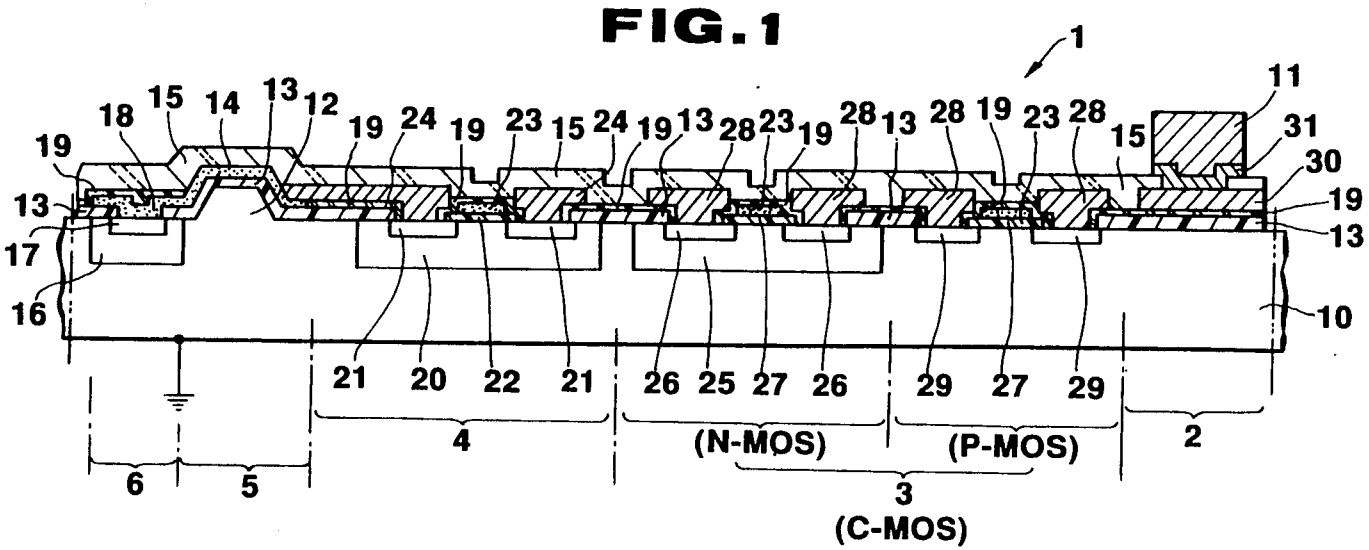
FIG. 1 is an enlarged sectional view showing a thermal print head according to a first embodiment of the present invention.

FIG. 1 is an enlarged sectional view showing a thermal print head 1. The head 1 has a single crystal N-type silicon substrate 10. The head substrate 10 corresponds to one block of a single crystal silicon substrate with a diameter of 4 to 8 inches, generally called a wafer. The thermal print head 1 comprises an external terminal section 2, a print data holding circuit section 3, a print current supply section 4, a heating section 5, and an earthing diode section 6, formed on the silicon substrate 10. Each of thermal print heads 1, as shown in FIG. 1, is obtained by dividing the silicon wafer (i.e., the silicon substrate 10) into a number of blocks, forming sections 2 to 6 on the substrate 10 for each block in parallel relation, and finally cutting off the block along the two-dot chain lines shown in FIG. 1.

Figure 3:
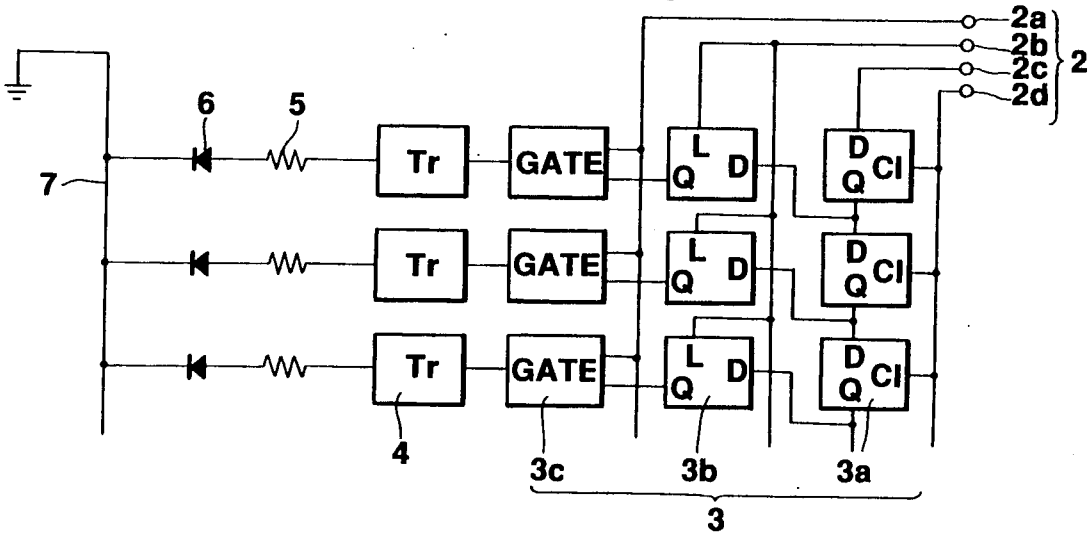
FIG. 3 is a block diagram of a circuit in the thermal print head of FIG. 1.

FIG. 3 is a block diagram of a circuit which is included in each individual thermal print head 1 shown in FIG. 1, that is, formed on the silicon substrate 10 for each block.

The external terminal section 2 includes a print control terminal 2*a*, a data latch terminal 2*b*, a data input terminal 2*c*, and a shift clock terminal 2*d*. The print data holding circuit section 3 includes a shift register 3*a*, latch circuit 3*b*, and gate elements 3*c*, such as AND gates. The shift register 3*a* shifts image data inputted through the data input terminal 2*c* in synchronism with a clock signal inputted through the shift clock terminal 2*d*. Latch circuits 3*b* simultaneously latch all bits of the print data for one line, in response to a latch signal inputted through a data latch terminal 2*b*, when the print data is delivered to the register 3*a*. Gate elements 3*c* are connected to a print timing signal inputted through the print control terminal 2*a*. The print current supply section 4 is composed of high-current transistors. Preferably, each transistor 4 is formed of an N-MOS-FET (N-type-channel Metal Oxide Semiconductor Field-Effect Transistor), as mentioned later. The print data holding circuit section 3 may be formed of a C-MOS-FET (Complemetnary Metal Oxide Semiconductor Field-effect Transistor). The heating section 5 includes heating elements respectively formed corresponding to each high-current transistor 4. The earthing diode section 6 serves to prevent the print current from flowing back into each heating element. The operation of each circuit element for printing is conventionally known, so that its description is omitted herein.

It is to be noted, however, that all the circuit elements from the print data holding circuit to heating element, in the thermal print head 1 shown in FIG. 3, are formed on one and the same silicon substrate 10. Accordingly, this circuit arrangement requires no bonding work. Moreover, the external terminal section requires use of only some control terminals as well as the data input terminals. It is to be understood, therefore, that the print head 1 and a control circuit substrate (not shown) can be bonded together with very high efficiency and reliability.

Arrangements of the individual sections will now be described in regular succession.

The heating section 5 is formed near a boundary line to an adjacent block of the silicon substrate 10. A protuberance 12 is formed along one side edge (perpendicular to the drawing plane of FIG. 1) near the adjacent block.

Figure 2A:
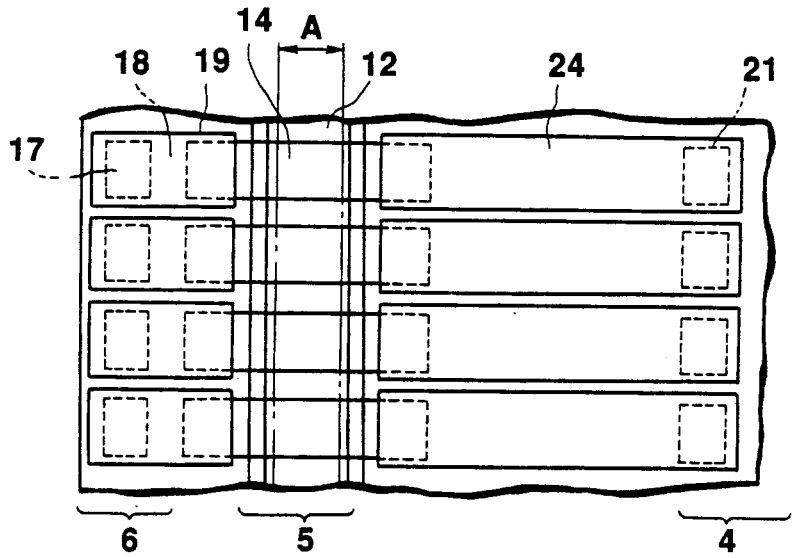
FIG. 2A is an enlarged plan view for illustrating an arrangement of a heating section shown in FIG. 1.
Figure 2B:
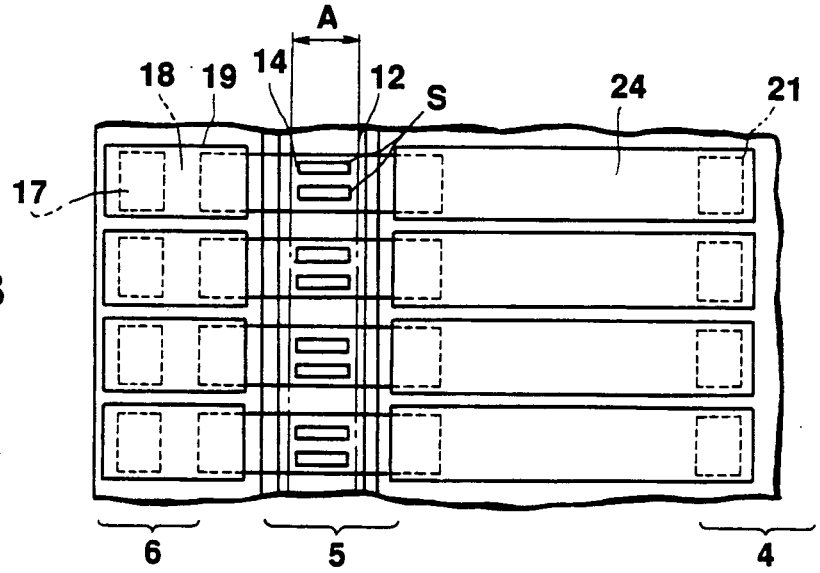
FIG. 2B is an enlarged plan view showing a modification of the heating section shown in FIG. 2A.

The protuberance 12 is covered by an insulating film 13 of $SiO_2$, and heating resistance elements 14, made of polycrystalline silicon doped with an impurity, are formed on the surface of the film 13. Having a trapezoidal cross section, the protuberance 12 extends over the full width of the silicon substrate 10 (in the vertical direction of FIG. 1), as shown in FIGS. 2A and 2B. Resistance elements 14 are arranged at regular pitches of 16 to 32 dots/mm along the longitudinal direction of the protuberance 12. In this case, each resistance element 14 is formed continuously extending from one base surface of the protuberance 12 to the other by way of the top surface of the protuberance 12. Element 14 is doped with a predetermined amount of phosphorus (P) ions as an impurity, thereby enjoying a predetermined sheet resistivity (tens of ohms/□). Thus, the total resistance of resistance element 14 depends on the implantation concentration of the P ions and its area. Accordingly, the total resistance is finally adjusted to tens to hundreds of ohms, depending on the amount of P-ion implantation and the unetched area. In this case, only a part portion of element 14 which faces the top surface of protuberance 12 is adjusted to the predetermined sheet resistance (tens of ohms/□), and the remaining portion is adjusted to a lower resistance. This will be described in detail later. A protective film 15 is formed on the surface of heating resistance elements 14. It may be formed as a double-layer structure of $SiO_2$ and SiN or a single-layer structure of SiON, employed resistance against oxidation and wear.

A P-type region 16 is formed inside the top surface of silicon substrate 10 by implantation of boron (B) ions. Formed inside the P-type region 16 is a N-type region 17 doped with P ions. P- and N-type regions 16 and 17 constitute an earthing diode section 6. The whole surface of the N-type region 17 except its central portion is covered by insulating film 13 of $SiO_2$. One end 18 of heating resistance element 14 is connected to the top surface of the region 17. A high insulation protective film 19, made of phosphorus-silica glass (PSG), is formed on the one end 18 of the element 14 by the CVD (Chemical Vapor Deposition) method, and the protective film 15 is formed on a film 19. The silicon substrate 10 itself serves as the earth line 7. In actually using the thermal print head of this type, a bottom surface 10*a* of the silicon substrate 10 is preferably connected to a ground line of the an apparatus which incorporates the head.

As mentioned before, the transistor 4 for current supply is an N-MOS-FET. In FIG. 1, numeral 20 denotes a P-type region doped with B ions, and two N-type regions 21 doped with P ions are formed within P-type region 20. Regions 21 constitute source and drain electrodes, individually. Gate insulating films 22 and gate electrode 23 are formed in layers between the two N-type regions. Films 22 and electrode 23 are made of $SiO_2$ and polycrystalline silicon, respectively. The surfaces of members 22 and 23 are coated with insulating protective films 19. Wiring conductors 24 for the source and the drain are formed corresponding to two N-type regions 21. In this case, the gate electrode 23, like the heating resistance element 14, is doped with P ions, so that its resistance is low. Conductors 24, which are formed of low resistance metal, such as Al, Al-Si, Mo, W, etc., are connected individually to N-type regions 21. One of conductors 24 is connected to the one end of resistance element 14. The protective film 15 also covers wiring conductors 24 and gate electrode 23. As seen from FIG. 1, each heating resistance element 14 is formed on the top surface of the protuberance 12, and its top surface projects above those of wiring conductors 24. If conductors 24 project above each resistance element 14, an identical portion of the protective film 15 which faces element 14 is depressed below the rest portion of the film 15 which face conductors 24. As a result, a gap is formed between the identical portion of the protective film 15 and a thermal ink sheet 48 (mentioned later), so that a heat conduction loss is entailed. In the thermal print head 1 of the present invention, however, the identical portion of the protective film 15 which faces each resistance element 14 projects above the rest of the film 15 on either side thereof, as seen from FIG. 1. This arrangement is highly effective in bringing the surface film 15 into intimate contact with the thermal ink sheet 48.

The shift register 3*a*, latch circuits 3*b*, and gate element 3*c* are respectively formed of C MOS-FETs. The C MOS FET, comprising of the combination of an N MOS N-channel MOS) FET and a PMOS FET (P-channel MOS), as is generally known, is located adjacent to the transistor 4 for current supply. Although only one C MOS FET is shown in FIG. 1, a plurality of C MOS FETs are actually arranged even within the drawing plane of FIG. 1. The actual size (length as in FIG. 1) of the C MOS FET is not greater than one-tenth that of the transistor 4. The N MOS FET is constructed in the same manner as the transistor 4. More specifically, the P-type region 25 doped with B ions is formed inside the top surface of the silicon substrate 10, and two N-type regions 26 doped with P ions are formed within P-type region 25. The gate insulating film 27 of $SiO_2$ and gate electrodes 23 of the polycrystalline silicon are formed in layers between the two N-type regions. Wiring conductors 28 for a source and a drain are formed corresponding to two N-type regions 26. Also in this case, gate electrodes 23 are doped with P ions, so that their resistances are low, and their surfaces are covered with the insulating protective film 19. The protective film 15 is formed covering wiring conductors 28 and portions of the film 19 on gate electrodes 23.

The P MOS FET is constructed in the same manner as the N MOS except that two P-type regions 29 are formed inside the top surface of the silicon substrate 10. More specifically, the gate insulating film 27, gate electrodes 23, and wiring conductors 28 are similar to those of the N MOS FET. Therefore, a description of those elements is omitted herein.

Terminals 2*a* to 2*d* of the external terminal section 2 are formed as bump electrodes 11. A wiring conductor 30 is formed on the insulating film 13 and the insulating protective film 19, which are formed in layers on the silicon substrate 10. The conductor 30 serves to connect terminals 2*a* to 2*d* with the shift register 3*a*, latch circuits 3*b*, or gate element 3*c*. The whole surface of the wiring conductor 30 except a specific portion is covered by the protective film 15. The barrier metal 31 is formed on the specific portion of the conductor 30 which is exposed from the film 15. A bump electrode 11 is formed on the barrier metal 31. Besides a Ti-W alloy, a single or laminate structure of Ti, Cu, Ti-N, W, or W-Si may be used for the barrier metal. A gold- or solder-based alloy may be used for the bump electrode 11.

Referring now to FIGS. 4A to 4K, processes for manufacturing the thermal print head 1 with the aforementioned construction will be described.

Each thermal print head 1 is obtained by dividing one wafer into a number of blocks, simultaneously forming the required elements for each block, and finally cutting off the block. In the description to follow, only one block of the wafer will be mentioned.

Figure 4A:
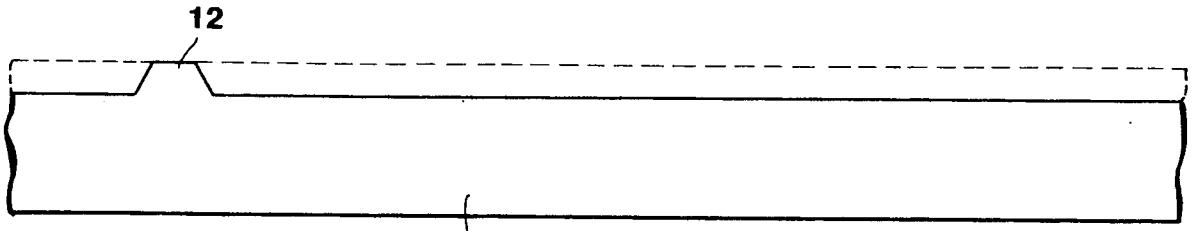
FIGS. 4A to 4K are enlarged sectional views showing individual processes for manufacturing the thermal print head of FIG. 1.

As shown in FIG. 4A, the single-crystal N-type silicon substrate (wafer) 10 is first prepared, and one side of the substrate 10 is etched so that the portion indicated by broken line is removed to form the protuberance 12. In this case, the etching thickness ranges from several micrometers to tens of micrometers. The etching may be prosecuted by plasma etching method, or be effected by the use of a chemical fluid consisting mainly of hydrofluoric acid.

Figure 4B:
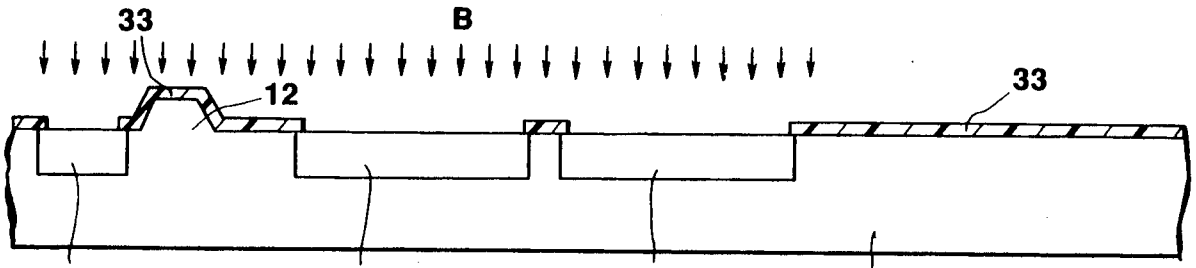

Thereafter, the silicon substrate 10 is heated to about 1,000° C. for a thermal oxidation treatment, so that a $SiO_2$ film 33 is formed in and on the surface of the substrate 10. Then, a photoresist film is patterned on the film 33 by photolithography. More specifically, the photoresist film is applied to the $SiO_2$ film 33, and is exposed to the light through a mask. The exposed photoresist film is developed to remove unnecessary portions. Thus, the photoresist film is patterned. Using the patterned photoresist film as a mask, the $SiO_2$ film 33 is etched so that unnecessary portions thereof, i.e., those portions corresponding to the respective P-type regions 16, 20 and 25 of the diode section 6, transistors 4, and the C MOS FETs are removed, as shown in FIG. 4B. B ions are implanted and diffused into those portions of the silicon substrate 10 cleared of the $SiO_2$ film 33, so that a multitude of the P-type regions 16, 20 and 25 are formed for each block, in the silicon substrate 10.

Figure 4C:
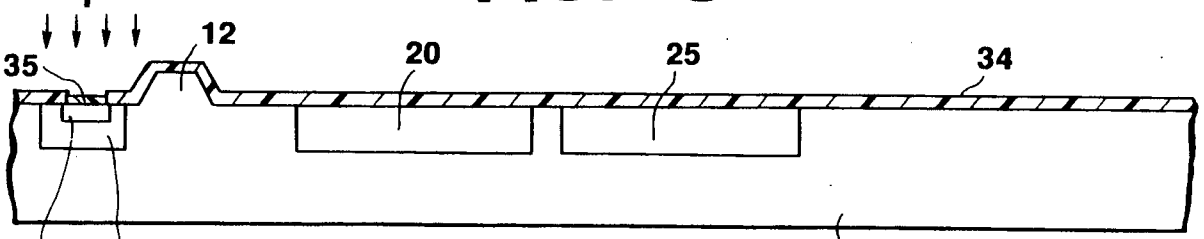

Thereafter, the $SiO_2$ film 33 is removed. Then, a $SiO_2$ film 34 is formed over the whole surface of the resulting structure, and a photoresist film (not shown) is patterned on the surface of the film 34 by photolithography. Using this photoresist film as a mask, the region for the formation of the diode section 6, that is, the portion corresponding to the P-type region 16, is removed by etching, and the gate insulating film 35 is formed on the exposed portion, as shown in FIG. 4C. The P ions are implanted into the P-type region 16 of the diode section 6 through the insulating film 35, thus forming the N-type region 17. In this case, the gate insulating film 35 serves to prevent the surface of the N-type region 17 from being damaged by the implantation of the P ions.

Figure 4D:
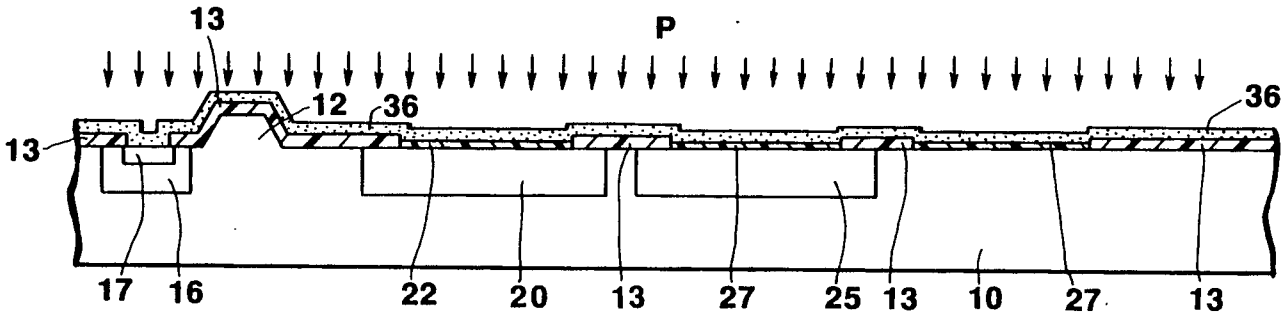
Figure 4E:
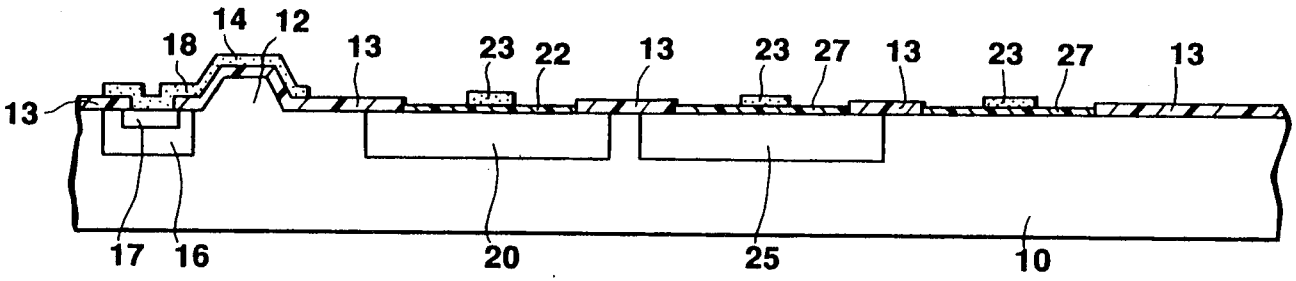

Thereafter, the $SiO_2$ film 34 and the gate insulating film 35 are removed by etching, and the silicon substrate 10 is subjected again to thermal oxidation treatment, whereby an $SiO_2$ film is formed on the surface of the substrate 10. A photoresist film is patterned on the surface Of the $SiO_2$ film by photolithography, and the $SiO_2$ film is etched with use of the photoresist film as a mask. Thereupon, those portions of the $SiO_2$ film which correspond to the respective P-type regions 20 and 25 of the transistor 4 and the C MOS FET and the region for the formation of the P MOS FET are removed, as shown in FIG. 4D. In this state, that portion (not shown) of the $SiO_2$ film which corresponds to the diode section 6 is not removed. Then, gate insulating films 22 and 27 are formed on the exposed portions by dry oxidation or oxidation of HCl. Thereafter, a photoresist film is formed again on the surfaces of the insulating film 13 of $SiO_2$ and gate insulating films 22 and 27 by photolithography, and only that portion of the $SiO_2$ film which corresponds to the N-type region 17 of the diode section 6 is then removed. As a result, the single-crystal silicon can be brought into contact with N-type region 17.

Further, a polycrystalline silicon layer 36 is formed on the whole surface of the resulting structure by the CVD method using a monosilane ($SiH_4$) gas. The P ions are implanted throughout the layer 36, as shown in FIG. 4D, so that the P-ion concentration of the layer 36 is increased, thereby reducing its resistance to a predetermined value. In this case, the P-ion concentration is previously adjusted in consideration of an increment corresponding to the amount of P ions implanted during the formation of the N-type regions 21 and 26 in a subsequent process (shown in FIG. 4F). More specifically, the sheet resistance of the polycrystalline silicon layer 36, which ranges from several kilohms/□ to several megohms/□ before the P-ion implantation, is finally adjusted to tens of ohms/□. In this case, only one process is needed provided the amount of P-ions implanted in those portions of the polycrystalline silicon layer 36 which correspond to the respective gate electrodes 23 of the transistor 4, the C MOS FET, etc. is equal to the amount in the portion corresponding to the heating resistance element 14. The amount of the P-ion implantation in the layer 36 can be increased by reimplanting the P ions only into the layer 36 with use of a resist mask, or by forming separate resist masks for separate processes.

Thereafter, a photoresist film is patterned on the surface of the polycrystalline silicon layer 36 by photolithography, and the layer 36 is etched by using the photoresist film as a mask, so that unnecessary portions of the layer 36 are removed. Thereupon, the diode section 6, heating resistance elements 14, transistors 4, P-type regions 20 and 25, and gate electrodes 23 are formed in the manner shown in FIG. 4E. An essential requirement for each resistance element 14 is that it be able to heat only required heating portions to improve the resolution. In the present embodiment, therefore, the resistance inside a region A of each resistance element 14, shown in FIGS. 2A and 2B, which corresponds to the top surface of the protuberance 12 is higher than the resistance outside. If the sectional area of the resistance element 14 is uniform, as shown in FIG. 2A, the P-ion density in the region A of each resistance element 14 is made lower than in any other region, or the portions outside the region A are doped with B ions. FIG. 2B shows a method in which slits S are formed in region A of each resistance element 14, so that the width of the electric conduction path in the region A is narrower than that of any other part outside the region A. In either case, the total resistance value of each resistance element 14 is adjusted to, e.g., tens to hundred of ohms.

Figure 4F:
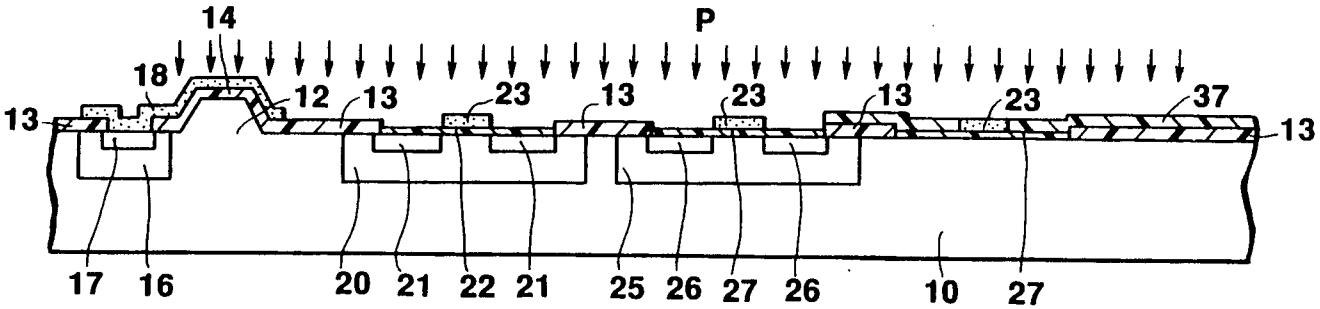

Subsequently, the gate insulating film 27 of the P MOS FET is masked by means of a photoresist film 37, and the P ions are implanted into the respective P-type regions 20 and 25 of the transistor 4 and the C MOS FET through the gate insulating film 22, thereby forming two sets of N-type regions 21 and 26, as shown in FIG. 4F. Regions 21 and 26 serve as sources and drains, respectively.

Figure 4G:
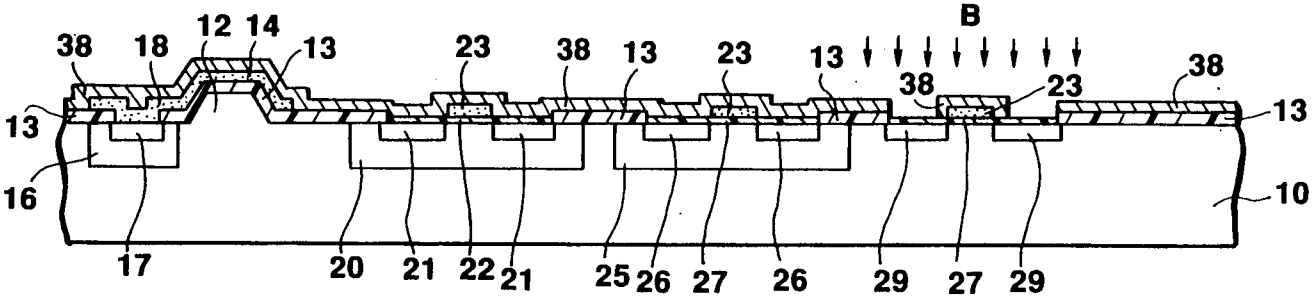

After the photoresist film 37 is removed by etching, a photoresist film 38 is patterned again on the whole surface of the resulting structure by photolithography, as shown in FIG. 4G. Then, using the film 38 as a mask, B ions are implanted into the silicon substrate 10 through the gate insulating film 27 of the P MOS FET, thereby forming two P-type regions 29. Regions 29 serve individually as a source and a drain.

Figure 4H:
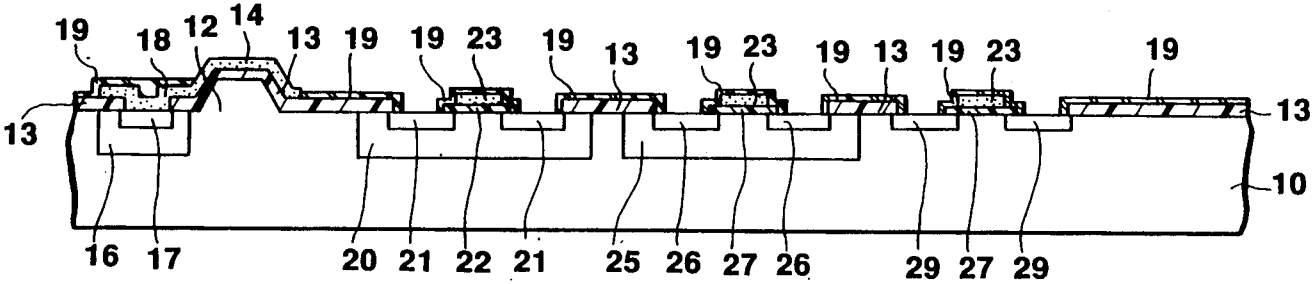

Thereafter, the photoresist film 38 is removed by etching. A photoresist film is patterned again on the structure by photolithography, and those portions of gate insulating films 22 and 27 which correspond to N-type regions 21 and 26 and P-type region 29 of the transistor 4 and the C MOS FET are removed by etching with use of the patterned photoresist film as a mask. Then, an insulating protective film of the PSG is formed on the whole surface of the resulting structure by the normal-pressure CVD method. A photoresist film is patterned on the surface of the insulating protective film by photolithography, and the protective film is etched by using this photoresist film as a mask. Thus, one end 18 of the heating resistance element 14, the respective gate electrodes 23 of the transistor 4 and the C MOS FET, and the insulating film 13 are covered by the insulating protective film 19 of the PSG, as shown in FIG. 4H.

Figure 4I:
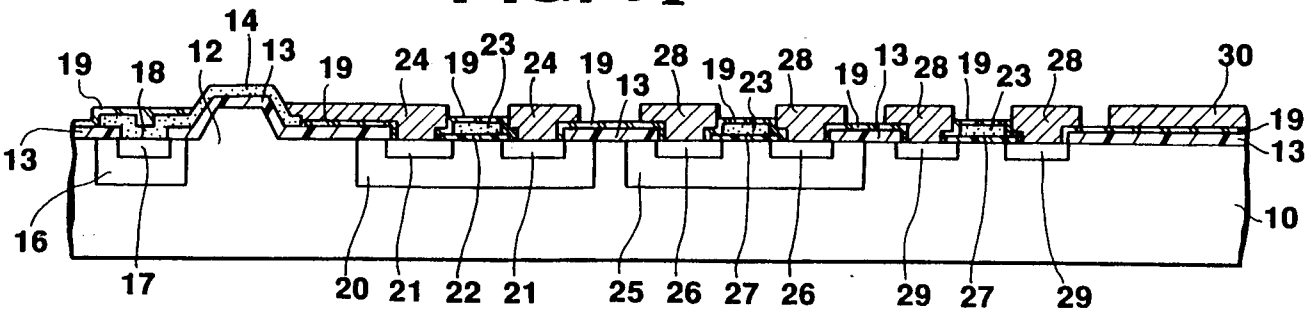

Subsequently, an electrically conductive metal film, such as Al, Al-Si, Mo, or W, is formed on the whole surface of the resulting structure by sputtering or vacuum evaporation. A photoresist film is patterned on the surface of the metal film by photolithography. Using this photoresist film as a mask, the metal film is etched to remove unnecessary portions. Thereupon, wiring conductors 24, 28 and 30 are formed on the portions corresponding to the respective N-type regions 21 and 26 of the transistor 4 and the C MOS FET, the portion corresponding to P-type region 29 of the P-MOS FET, and the portion corresponding to the bump electrode 11, as shown in FIG. 4I. Conductors 24 and 28 are connected electrically to N-type regions 21 and 26 and P-type region 29. In this case, one of wiring conductors 24 of the transistor 4 is also connected electrically to the resistance element 14.

Figure 4J:
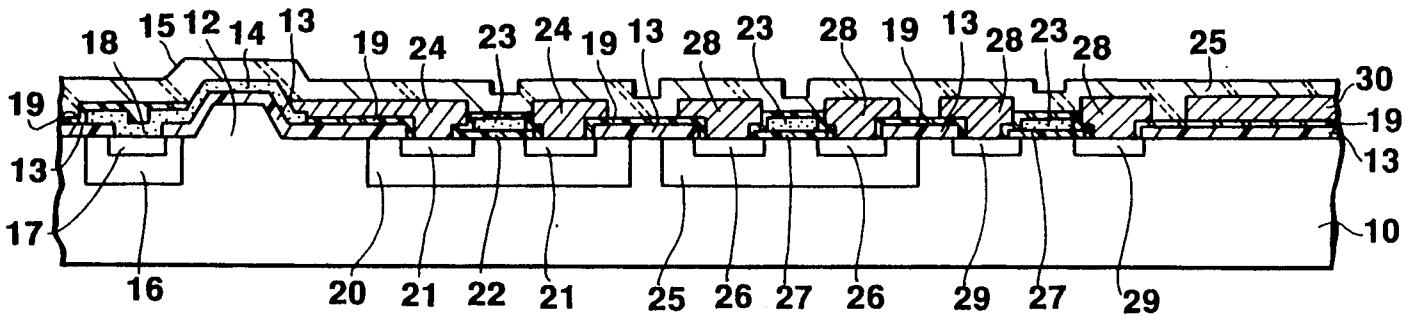

Thereafter, the protective film 15 is formed on the whole surface of the resulting structure by sputtering or vacuum evaporation, as shown in FIG. 4J. As mentioned before, the film 15 is a double-layer structure of the $SiO_2$ and SiN or a single-layer structure of SiON, having resistance against oxidation and wear, and may be formed by the CVD method or the like. Further, that portion of the protective film 15 which corresponds to the protuberance 12 is raised above other portions.

Figure 4K:
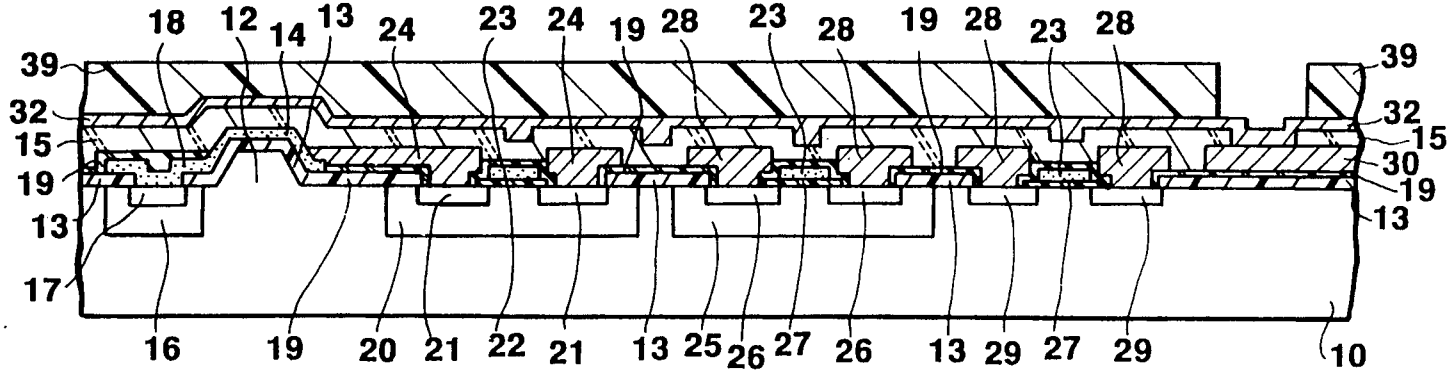

A photoresist film is patterned on the surface of the protective film 15 by photolithography. Using this photoresist film as a mask, the film 15 is etched so that an unnecessary portion, i.e., the portion corresponding to the bump electrode 11, is removed, as shown in FIG. 4K. Thereafter, the photoresist film is removed, and a Ti-W alloy, as a barrier metal, and Au, as a metal for intimate contact, are deposited. Successively on the whole surface of the etched protective film by vacuum evaporation or sputtering, thereby forming the metal layer 32. Further, a resist 39 is deposited on the surface of the layer 32 by spin coating, and the bump forming region is removed by etching. The etched portion is plated with Au, thus forming the bump electrode 11. The height of the bump electrode 11 is adjusted to about 10 to 30 μm, in order to maximize the strength of bonding between the electrode 11 and an external electrode.

Subsequently, the resist 39 and the whole region of the metal layer 32 except the portion corresponding to the bump electrode 11 are removed successively by etching. Thereupon, each block of the wafer is brought to the state shown in FIG. 1. Finally, the silicon substrate 10 is diced into individual blocks along the two-dot chain lines of FIG. 1. Thus, the thermal print head 1 of the present invention is obtained.

Figure 5:
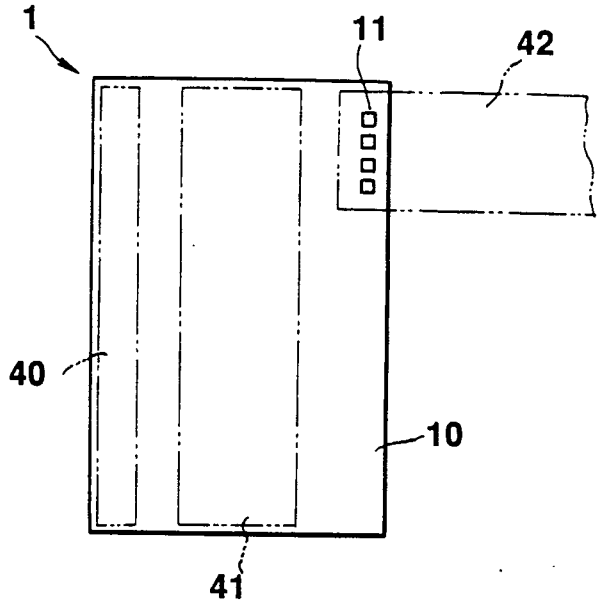
FIG. 5 is a plan view showing a state in which a flexible connector is connected to the thermal print head of FIG. 1.
Figure 6:
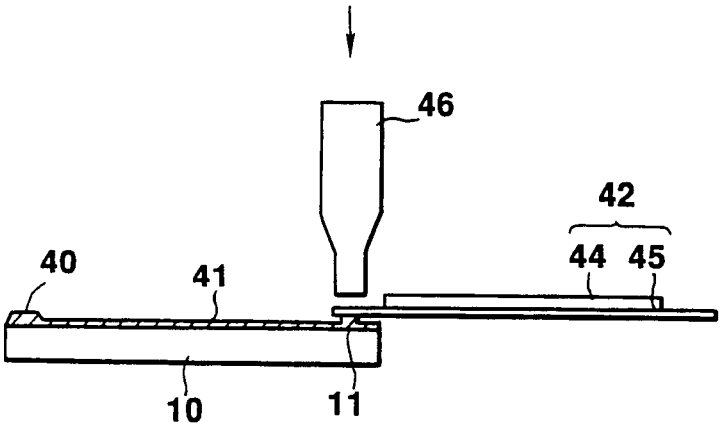
FIG. 6 is a side view for illustrating a method for the connection shown in FIG. 5.
Figure 7:
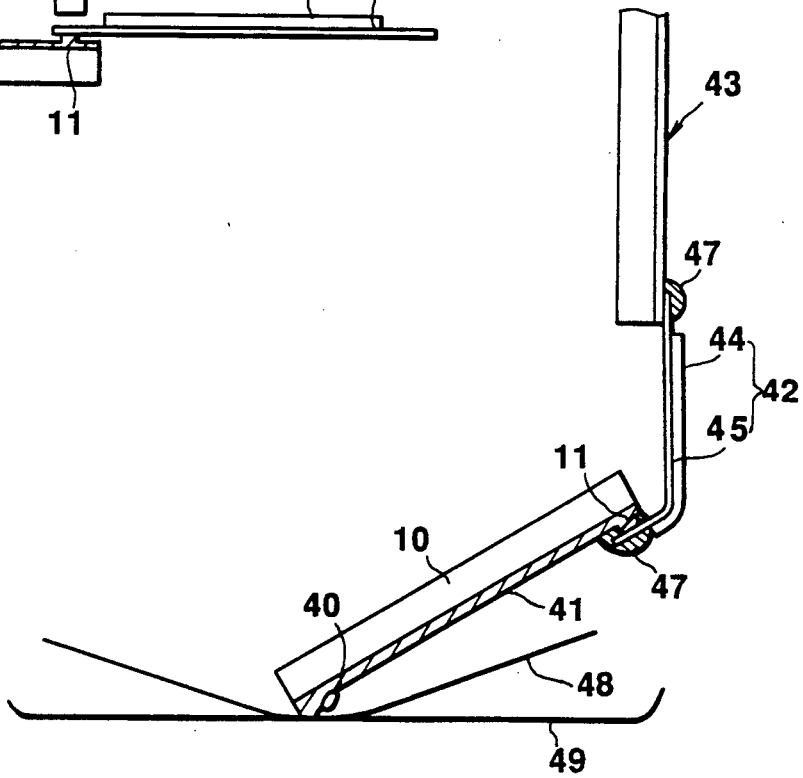
FIG. 7 is a side view showing an example of use of the thermal print head of FIG. 1.

Referring now to FIGS. 5 to 7, there will be described the way the aforementioned thermal print head is connected to a circuit substrate 43 of an apparatus.

As shown in FIG. 5, the thermal print head 1 is in the form of a substantially rectangular plate. A heating element region 40, which has a number of the heating resistance elements 14 and earthing diodes 6 thereon, is formed on one side edge of the silicon substrate 10. A print driver circuit element region 41, which is provided with transistors 4 for current supply and elements for print data transfer, is formed in the central portion of the substrate 10, and bump electrodes 11 are formed along the other side edge of the substrate 10. Bump electrodes 11 are connected to one end of a flexible connector 42, the other end of which is connected to a circuit substrate 43 (FIG. 7) of the apparatus. Wires 45, which are composed of copper leaf plated with solder, are formed on one side of the connector 42. The respective one ends of wires 45 are disposed on bump electrodes 11, and are bonded thereto at a time by means of a heat-pressure bonding device 46. The junction is covered by an insulating adhesive agent 47, such as silicone rubber (FIG. 7). The respective other ends of wires 45 are temporarily bonded to the circuit substrate 43 by means of the bonding device 46. Also in this case, the junction is covered by the insulating adhesive agent 47. The circuit substrate 43 supplies the thermal print head 1 with an image signal, a clock signal, a strobe signal, and an enable signal, thereby driving the head.

The thermal print head 1, thus connected to the flexible connector 42, is bent at the portion corresponding to the connector 42, and is kept tilted with the heating element region 40 downward, as shown in FIG. 7.

If the specific signals (image signal, clock signal, strobe signal, and enable signal) are supplied from the circuit substrate 43 through the flexible connector 42 to the thermal print head 1, in this state, heating resistance elements 14 are selectively heated. Thereupon, ink on a thermal ink sheet 48 is transferred to a recording sheet 49 by the resulting heat, thereby effecting thermal recording. In this case, that portion of protective film 15 which corresponds to the protuberance 12 projects above the other portions. Therefore, the surface of only that portion of the film 15 which faces each resistance element 14 can be satisfactorily brought into intimate contact with the ink sheet 48. Thus, a distinct thermal recording can be effected. Since resistance elements 14 are connected to earthing diodes 6, in particular, electric current can be securely prevented from flowing backward by diodes 6. Thus, the thermal recording can be effected with high resolution.

It is to be understood that the present invention is not limited to the embodiment described above, and that various changes and modifications may be effected therein by one skilled in the art without departing from the scope or spirit of the invention. Instead of using the thermal ink sheet 48 for the thermal recording on the recording sheet 49, for example, the thermal print head 1 may be brought directly into contact with a thermal paper sheet for thermal recording. Further, the one end of each heating resistance element 14 need not always be connected to its corresponding diode 6, and may alternatively be connected to a wiring conductor as an earth line.

Although N-type regions 17, 21 and 26 and P-type region 29, in the embodiment described above, are formed by ion implantation, they may alternatively be formed by thermal diffusion. In forming the N-type region by thermal diffusion, P ions are diffused into P-type regions 20 and 25 after removing gate insulating films 22 and 27 by etching. In this case, P ions are implanted into resistance element 14 in a separate process.

In the embodiment described above, furthermore, P-type region 29 is formed after N-type regions 21 and 26 are formed. Alternatively, however, N-type regions 21 and 26 may be formed after P-type region 29 is formed. Further, the polycrystalline silicon layer 36 may be formed after N-type regions 21 and 26 and P-type region 29 are formed.

Preferably, the heating element region 40 is located close to the side edge portion of the silicon substrate 10, as seen from FIG. 7, in order that the region 40 can be brought into intimate contact with the recording sheet 49. In order to reduce the resistance value, however, conventional earthing conductors require a width of several millimeters to several centimeters. In the present invention, earthing diodes 6 are arranged in place of the earthing conductors, so that heating resistance elements 14 can be located much closer to the side edge portion of the silicon substrate 10 than in the conventional arrangement.

The resistance elements 14 may, however, be located close to the side edge portion of the silicon substrate 10 by using any other suitable means. The following is a description of an example of such means.

Second Embodiment

Figure 8:
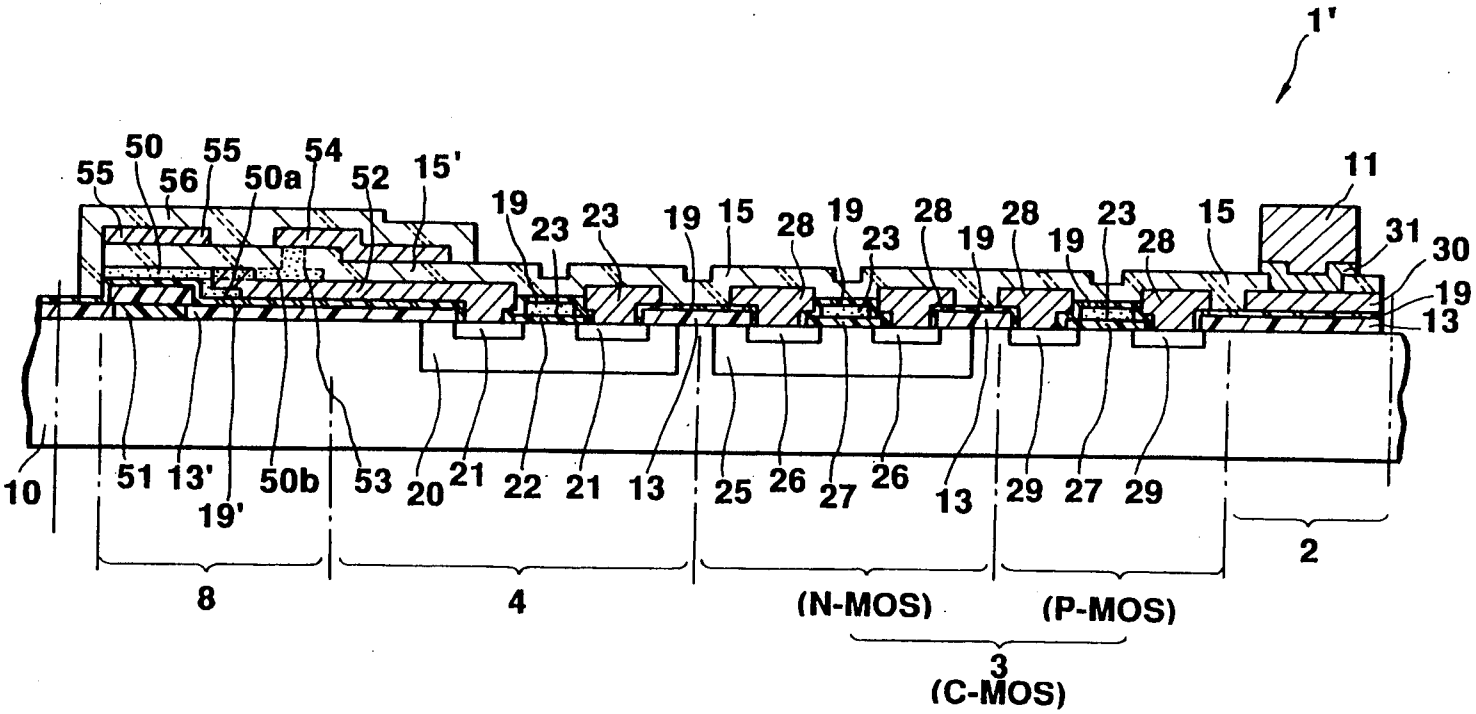
FIG. 8 is an enlarged sectional view showing a thermal print head according to a second embodiment of the invention.
Figure 9:
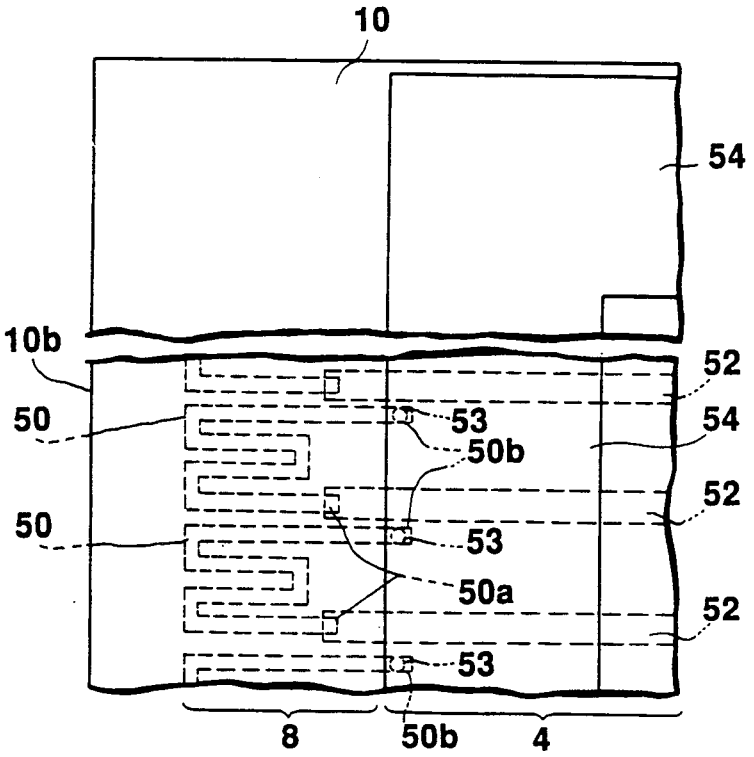
FIG. 9 is an enlarged sectional view for illustrating an arrangement of a heating section shown in FIG. 8.
Figure 10:
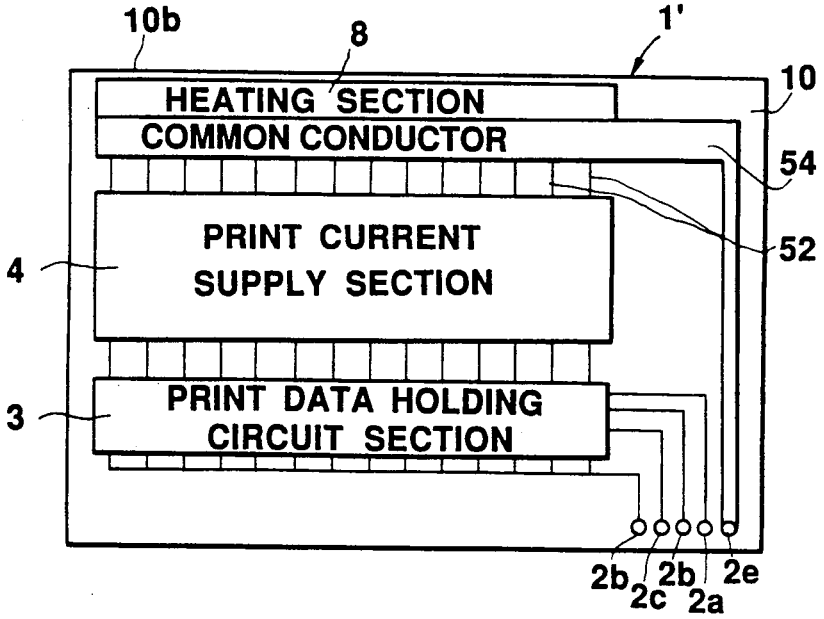
FIG. 10 shows a layout of circuit components of the thermal print head shown in FIG. 8.

FIGS. 8 to 10 show a thermal print head 1' according to a second embodiment of the present invention.

FIG. 8 is an enlarged sectional view of the thermal print head 1'. The head 1' comprises the external terminal section 2, print data holding circuit section 3, print current supply section 4, and heating section 8.

All the sections or elements of the thermal print head 1' except the heating section 8 are constructed in the same manner as their counterparts of the thermal print head 1 of the first embodiment. In the description to follow, therefore, like reference numerals are used to designate like portions.

The heating section 8 corresponds to the heating section 4 of the thermal print head 1 of the first embodiment. The greatest difference between heads 1 and 1' lies in that the head 1' does not comprise the earthing diode section 6. Instead, the thermal print head 1' comprises a common conductor for connecting all heating resistance elements in common. In contrast with the case of the conventional thermal print head, however, the common conductor is formed on an insulating layer which overlies individual selective conductors.

In FIG. 8, numeral 51 denotes a glazed layer of, e.g., $SiO_2$ or SiN. The glazed layer 51 is formed on the silicon Substrate 10, for example, in a manner such that no other elements are on the substrate. It serves to store the heat produced in the heating resistance elements mentioned later, and delay the dissipation of the heat from substrate 10.

The glazed layer 51 is covered by an insulating film 13' of $SiO_2$ and an insulating protective film 19'. Films 13' and 19' correspond to insulating film 13 and the insulating protective film 19, respectively, of the first embodiment. The heating resistance element 50 is formed on that portion of the insulating protective film 19' which corresponds to the glazed layer 51. One end **50*a* of the resistance element 50, which extends to that portion of the film 19' around the layer 51, is connected to a selective conductor 52**.

As shown in FIG. 9, heating resistance elements 50 are arranged along one side edge **10*b* of the silicon substrate 10. Each resistance element 50** has a zigzag shape.

Each heating resistance element 50 has an other end **50*b* which extends in the same direction as one end 50*a*. As in the first embodiment, the element 50 is covered by a protective film 15'. A hole 53 is bored through that portion of the resistance element 50 which faces the other end 50*b*. Formed on the protective film 15' is a common conductor 54 which extends at right angles to each selective conductor 52. The other end 50*b* of each resistance element 50 is connected to the common conductor 54 via through hole 53**.

A heat conductor film 55 is formed on that portion of the protective film 15' which faces the heating resistance element 50. The film 15' is formed of a rigid layer of metal, such as Mo or W. It serves to store the heat temporarily, thereby easing the heat dissipation, and to make the temperature inside the area for the heat conductor film 55 uniform.

The respective upper surfaces of the heat conductor film 55 and the common conductor 54 are covered by a protective film 56.

The common conductor 54, which extends along the other side edge portion of the silicon substrate 10, is connected to the earthing terminal 2*e*, as shown in FIG. 10. FIG. 10 shows a layout of element forming portions of the thermal print head 1'. The silicon substrate 10 is cut along the two-dot chain lines of FIG. 8, whereby each individual thermal print head 1' shown in FIG. 10 is obtained. In this case, the common conductor 54 is disposed on the selective conductors 52, so that the heating section can be brought very close to one side edge 10*b* of the silicon substrate 10.

Figure 11:
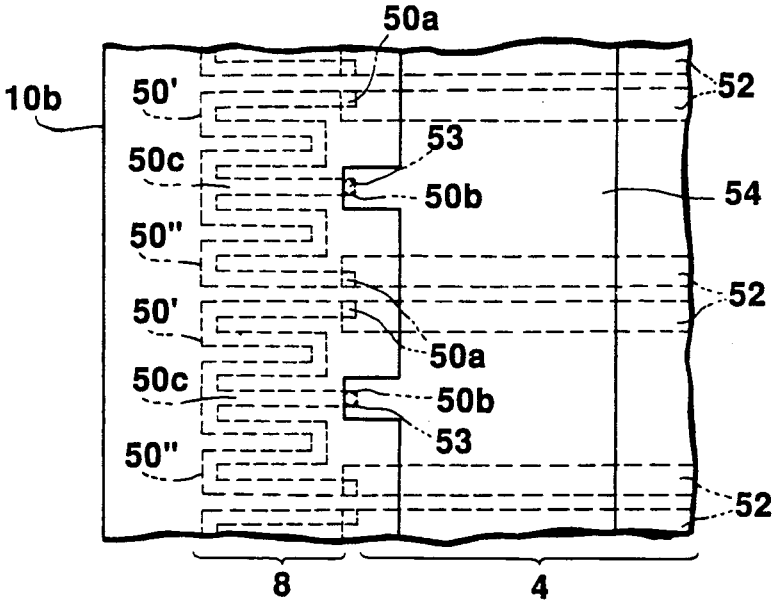
FIG. 11 is an enlarged sectional view showing a modification of the heating section shown in FIG. 9.

FIG. 11 shows a modification of the heating section 8. In this modification, each heating resistance element 50' has an other end 50*b* in common with its adjacent resistance element 50''. Thus, the resistance elements 50' and 50'' are alternately arranged along the one side edge 10*b* of the substrate 10. Each two adjacent resistance elements 50' and 50'' are formed integrally with each other by means of a common line 50*c*. The line 50*c* is connected, at other end 50*b*, to the common conductor 54 via the hole 53. The heating resistance elements 50' and 50'' are linearly symmetrical with respect to common line 50*c*. Ends 50*a* of resistance elements 50' and 50'' are connected to their corresponding selective conductors 52. In this wire arrangement, elements 50' and 50'' are driven in a time-sharing mode. Thus, when the resistance element 50' is driven in response to the print timing signal, each selective conductor 52 connected to one end 50*a* of each corresponding resistance element 50'' is cut off by means of a switching element (not shown). When the resistance element 50'' is driven for printing, on the other hand, each selective conductor 52 connected to one end 50*a* of each corresponding resistance element 50' is dead.

The thermal print head 1' of the second embodiment, like the thermal print head 1 of the first embodiment, can be connected to circuit substrate 43 by means of the flexible connector 42, as shown in FIG. 7, when it is used.

However, a plurality of thermal print heads 1 or 1' may be arranged on an insulating substrate so that a thermal printing apparatus can be constructed having a longer heating section. The following is a description of the thermal printing apparatus.

Thermal Printing Apparatus

Figure 12:
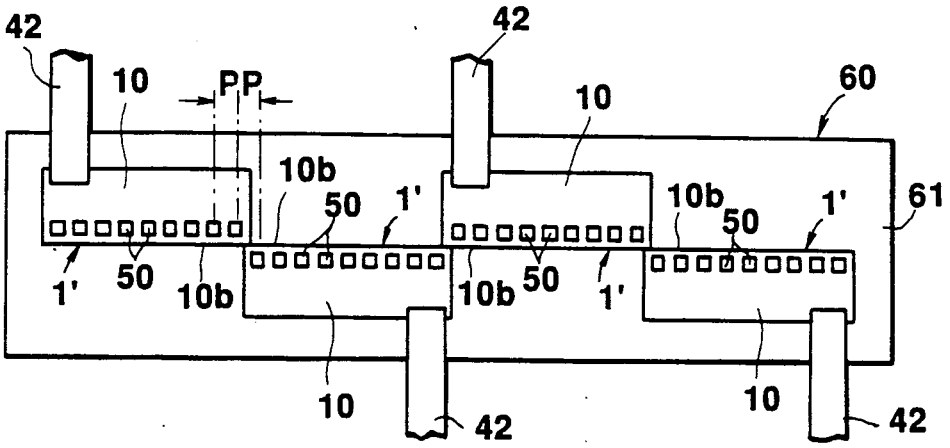
FIG. 12 is a plan view of a thermal printing apparatus constructed using the thermal print head of FIG. 8.

FIG. 12 shows a thermal printing apparatus 60 with a long heating section used in a line printer or facsimile. In connection with FIG. 12, the thermal print head 1' of the second embodiment will be described. It is to be understood, however, that the thermal printing apparatus 60 of the same construction can be obtained with use of the thermal print head 1 of the first embodiment.

The thermal printing apparatus 60 includes a supporting substrate 61. The substrate 61, which is formed of ceramics, metal, quartz, etc., is wide enough to carry the thermal print heads 1' in two lines. Thus, a number of heads 1' are arranged in two lines on the substrate 61. The heads 1' are oriented so that their side edges 10*b*, along which heating resistance elements 50 are arranged, are directed to the center of the supporting substrate 61. The thermal print heads 1' are arranged substantially alternately along the two lines so that each print head 1' overlaps its adjacent print heads 1' only at the opposite end portions of its side edge 10*b*, with respect to the longitudinal direction. In this case, heads 1' are relatively situated so as to maintain pitch P of heating resistance elements 50. Thus, the distance between the last (or first) resistance element 50 of each head 1' and the first (or last) resistance element 50 of each adjacent head 1' is equal to pitch P of elements 50.

The thermal print heads 1', arranged in this manner, are positioned and bonded on the supporting substrate 61, with side edges 10*b* of their respective silicon substrates 10 in intimate contact so that their heating resistance elements 50 are situated close to one another. The flexible connector 42 is connected to terminals 2*a* to 2*e* of each head 1', as shown in FIG. 6. The connectors 42 is also connected to, e.g., a circuit substrate (not shown) of the apparatus.

The thermal printing apparatus 60 of this type can be applied to a line printer or facsimile, despite the use of a single-crystal semiconductor wafer for the substrate. In this case, heating resistance elements 50 are located close to one side edge 10*b* of the silicon substrate 10, so that all the resistance elements can be pressed against the recording sheet under substantially uniform conditions. Thus, the apparatus can enjoy improved print quality.

What is claimed is:

1. A thermal print head, comprising:

a single-crystal semiconductor substrate;

a print driver circuit element formed by implanting an impurity into a predetermined region of said semiconductor substrate;

a polycrystalline silicon layer formed on said semiconductor substrate and including a low resistance region for heating;

a thin film conductor for wiring, said conductor connecting said print driver circuit element and said polycrystalline silicon layer;

an external connecting terminal connected to said thin film conductor; and an insulating protective film covering said print driver circuit element and said polycrystalline silicon layer;

wherein said print driver circuit element includes a shift register element for successively shifting print data inputted from said external connecting terminal, a latch circuit element for latching the data in said shift register element, and a current supply element for supplying electric current for heating to said low resistance region in accordance with the data held in said latch circuit element.

2. The thermal print head according to claim 1, wherein said shift register element, latch circuit element, and current supply element are each formed of an MOS FET.

3. The thermal print head according to claim 1, wherein said shift register element and said latch circuit element are each formed of a complementary MOS FET.

4. The thermal print head according to claim 1, wherein said current supply element is formed of an N-type-channel MOS FET.

5. The thermal print head according to claim 1, wherein said external connecting terminal is formed projecting outward from the surface of said insulating protective film.

6. A thermal print head, comprising:

a single-crystal semiconductor substrate;

a print driver circuit element formed in a predetermined region of said semiconductor substrate;

a plurality of polycrystalline silicon elements each having two ends arranged in parallel fashion on said semiconductor substrate;

a plurality of selective conductors connecting a print driver circuit element among said polycrystalline silicon elements and one end of said corresponding polycrystalline silicon element;

an insulating layer covering said polycrystalline silicon elements and said selective conductors; and a common conductor formed along an arrangement direction of said selective conductors, on said insulating layer to correspond to said selective conductors, and having portions for connecting the respective other ends of said polycrystalline silicon elements.

7. A thermal printing apparatus comprising:

a plurality of thermal print heads each including a substrate, a print driver circuit element formed in a predetermined region of said substrate;

a heating region formed of a number of heating elements formed along one side edge of said substrate, a glazed layer for heat accumulation formed between said heating elements and said substrate, selective conductors connecting said print driver circuit element and one end of each of said heating elements, a common conductor connecting the respective other ends of said heating elements, and a plurality of external connecting terminals connected to said print driver circuit element;

a supporting substrate having a bearing surface carrying said thermal print heads in two lines; and bonding means for bonding said thermal print heads to said supporting substrate, wherein said thermal print heads are arranged in two offset lines on said supporting substrate so that the heating region of each print head cannot overlap a heating region of each adjacent print head with respect to the longitudinal direction of said supporting substrate, and that a respective one side edges of said substrates of each two adjacent print heads face each other.

8. The thermal printing apparatus according to claim 7, wherein an insulating layer is formed on said selective conductors, and said common conductor is formed on said insulating layer.

9. A thermal print head, comprising:

a single-crystal semiconductor substrate;

a print driver circuit element formed by implanting an impurity into a predetermined region of said semiconductor substrate;

a polycrystalline silicon layer formed over said semiconductor substrate and insulating a low resistance region for heating;

an insulating layer interposed between said substrate and said polycrystalline silicon layer;

a thin film conductor for wiring, said conductor connecting said print driver circuit element and said polycrystalline silicon layer;

an external connecting terminal connected to said thin film conductor; and an insulating protective film covering said print driver circuit element and said polycrystalline silicon layer.

10. The thermal print head according to claim 9, wherein said insulating protective film provides a protuberant portion at an area corresponding to said polycrystalline silicon layer for heating.

11. The thermal print head according to claim 10, wherein said shift register element and said latch circuit element are each formed of a complementary MOS FET.

12. The thermal print head according to claim 10, wherein said shift register element and said latch circuit element are each formed of a complementary MOS FET.

13. The thermal print head according to claim 9, wherein said print driver circuit element includes a shift register element for successively shifting print data inputted from said external connecting terminal, a latch circuit element for latching the data in said shift register element, and a current supply element for supplying electric current for heating to said low resistance region in accordance with the data held in said latch circuit element.

* * * * *